US005720389A

United States Patent [19]

Yamazaki et al.

[11] Patent Number: 5,720,389

[45] Date of Patent: Feb. 24, 1998

[54] PLASTIC CASE FOR PHOTOGRAPHIC FILM CASSETTE

[75] Inventors: Tetsuya Yamazaki; Morio Fujiwara, both of Kanagawa, Japan

[73] Assignee: Fuji Photo Film Co., Ltd., Kanagawa, Japan

[21] Appl. No.: 628,345

[22] Filed: Apr. 5, 1996

[30] Foreign Application Priority Data

Apr. 7, 1995 [JP] Japan ..... 7-082972
Apr. 14, 1995 [JP] Japan ..... 7-089384

[51] Int. Cl.[6] ..... B65D 85/38

[52] U.S. Cl. ..... 206/316.1; 206/455; 206/525; 206/583

[58] Field of Search ..... 206/316.1, 389, 206/308, 455, 521.2, 525, 578, 583, 590, 591; 215/372, 373, 376

[56] References Cited

U.S. PATENT DOCUMENTS

| | | | |
|---|---|---|---|
| 3,529,531 | 9/1970 | Swett | 206/525 |
| 3,726,394 | 4/1973 | Wachter | 206/525 |
| 4,605,127 | 8/1986 | Magnussen, Jr. | 206/525 |
| 4,639,386 | 1/1987 | Akao | 206/389 |
| 5,139,165 | 8/1992 | Hara | 206/389 |
| 5,240,754 | 8/1993 | Akao et al. | 206/389 |
| 5,330,053 | 7/1994 | Tabuchi et al. | 206/455 |

FOREIGN PATENT DOCUMENTS

| | | |
|---|---|---|
| 5-127317 | 5/1993 | Japan . |
| 5-150402 | 6/1993 | Japan . |
| 5-297522 | 11/1993 | Japan . |
| 6-222512 | 8/1994 | Japan . |

*Primary Examiner*—David T. Fidei
*Attorney, Agent, or Firm*—Sughrue, Mion, Zinn, Macpeak & Seas, PLLC

[57] ABSTRACT

A plastic case for a photographic film cassette consisting of a case body having a closed bottom and an open top, and a lid to be fitted to the open top of the case body, characterized by comprising a supporting device formed integrally on an internal bottom surface of the case body. The supporting device is upwardly tapered and deformable by the photographic film cassette when the lid is fitted to the case body and depresses the photographic film cassette into the case body. The supporting device is constituted of a pair of supporting ribs whose upper ends have a thickness of 0.12 to 0.35 mm. The ribs are disposed apart from each other, and the upper ends are inclined in opposite directions to each other relative to the internal bottom surface of the case body.

17 Claims, 13 Drawing Sheets

FIG. 20

| | THICKNESS T2 OF UPPER END OF RIB (mm) | SUITABILITY FOR FILLING | MOLD MAKING FACILITY | MOISTURE RESISTANCE (DEFORMATION PROPERTIES OF RIB) |
|---|---|---|---|---|
| COMPARATIVE EXAMPLE 1 | 0.07 | X | X | VG |
| COMPARATIVE EXAMPLE 2 | 0.10 | O | X | VG |
| EMBODYMENT 1 | 0.12 | G | O | VG |
| EMBODYMENT 2 | 0.14 | G | G | VG |
| EMBODYMENT 3 | 0.20 | G | G | VG |
| EMBODYMENT 4 | 0.25 | G | G | VG |
| EMBODYMENT 5 | 0.30 | G | G | G |
| EMBODYMENT 6 | 0.35 | G | VG | O |
| COMPARATIVE EXAMPLE 3 | 0.40 | VG | VG | X |

PLASTIC CASE FOR PHOTOGRAPHIC FILM CASSETTE

BACKGROUND OF THE INVENTION

1. Field of the Invention

The present invention relates to a plastic case for a photographic film cassette, especially for a photographic film cassette having a port portion protruding radially outward from the peripheral surface of a cylindrical cassette shell.

2. Related Art

In a conventional ISO 135-type photographic film cassette, a roll of photographic film is contained in a cassette shell made of a metal sheet. The ISO 135photographic film cassette is encased in a plastic case made especially for keeping the photographic film cassette and, thereafter, packed in a rectangular box (e.g. a cardboard box ) for sale.

The conventional plastic case for the photographic film cassette is constituted of a case body having a closed bottom and a lid for tightly closing an open top of the case body. The case body and the lid are each formed from resins. The plastic case is intended to protect the photographic film from moisture, and is thus required to have a high moisture resistance or a low moisture permeability of not more than 5–10 mg/24 hours. Since the conventional photographic film cassette is substantially cylindrical except that a port portion forming a film passageway protrudes slightly from the peripheral surface of the cassette shell, the conventional plastic case also has a fundamentally circular peripheral contour. Because tight-fitness of engagement between two plastic parts can be kept better in curves than straight portions, it has been relatively easy to tightly seal the conventional regular cylindrical plastic case by fitting the lid to the open top of the case body.

On the other hand, photographic film cassettes are disclosed, for example, in JP-A-5-127317 and JP-A-5-150402, whose cassette shell is constituted of elements made from resins, and which can wind the entire length of photographic film thereinto and advance the film leader to the outside by rotating the spool of the cassette. This type of photographic film cassette has a different contour from conventional ones, as is shown, for example, in FIG. 21. This is mainly because the new type photographic film cassette 90 needs to have an elongated port portion 90*b* for shielding the photographic film from ambient light entering through a film passageway 90*a*, and also enabling the film leader to be advanced to the outside through the film passageway 90*a*.

Since the new type photographic film cassette does not have a regular cylindrical contour, larger unused spaces 100*a* and 100*b* would result if the new type photographic film cassette 90 is encased in a conventional regular cylindrical plastic case 100. That is, space efficiency of the plastic case would be low.

To improve space efficiency, there have been suggested those plastic cases whose case body 110 has a substantially oval or oblong peripheral contour, as shown in FIG. 22. Although an unused room between the case body 110 and the new type photographic film cassette 90 is remarkably reduced, the cassette 90 would be unstable because of irregular spacings or distances between the periphery of the cassette 90 and the inner periphery of the case body 110.

JP-A-5-297522 discloses a case for a photographic film cassette, wherein an elastic material such as a sponge or spring is disposed inside a case body so that the cassette pops up the case body when a lid is opened. The elastic material is also provided for holding the photographic film cassette stable in the case. However, the elastic material as a separate part increases the production cost.

JP-A-6-222512 also discloses a case for a photographic film cassette, wherein a single rib comes into slidable contact with a side surface of the cassette so as to hold the cassette stable in the case. That configuration could not be applicable to a case for containing the new type photographic film cassette because of variable spacings between the non-circular outer periphery of the cassette and the inner periphery of the case. That is, if the photographic film cassette is being improperly oriented, the rib could not be in contact with the outer periphery of the cassette, or could even interfere with the cassette and hinder insertion of the cassette into the case body.

On the other hand, the photographic film cassette 90 is applied with a label 95 on a peripheral area. The label 95 has information about the photographic film printed thereon. In order to make the label 95 visible through the plastic case, a plastic resin material of the case should be transparent or semi-transparent. If the case has a substantially oval peripheral contour, as shown in FIG. 22, the information on the label 95 could be difficult to read because of the irregular spacings between the periphery of the cassette 90 and the case body, especially when the case body is semi-transparent.

OBJECTS OF THE INVENTION

In view of the foregoing, a primary object of the invention is to provide a plastic case which can contain a new type photographic film cassette having a protruding port portion in a stable fashion.

The plastic case should facilitate reading information on a label of the photographic film cassette contained therein.

The plastic case should be produced at a low cost by injection molding.

Another object of the invention is to improve the plastic case with respect to mold release properties and moldability.

SUMMARY OF THE INVENTION

To achieve the above and other objects in a plastic case for a photographic film cassette, which is constituted of a case body having a closed bottom and an open top, and a lid to be fitted to the open top, the present invention provides a supporting device formed integrally on an internal bottom surface of the case body, the supporting device being upwardly tapered and deformable by the photographic film cassette when the lid is fitted to the case body and depresses the photographic film cassette into the case body.

The supporting device is preferably constituted of a plurality of supporting ribs whose upper ends have a thickness of 0.12 to 0.35 mm.

According to a preferred embodiment, the plurality of supporting ribs are a pair of ribs whose upper ends are inclined relative to the internal bottom surface of the case body, so that a peripheral area of the photographic film cassette is set closer to an inner periphery of the case body. In this way, a label, which may be put on the peripheral area of the photographic film cassette, is disposed closer to the inner periphery of the case body, so that the label can be easy to read.

It is preferable to space the pair of ribs apart from each other and incline the upper ends in opposite directions to each other. The inclination is preferably not less than 6 degrees relative to the internal bottom surface of the case body. It is more preferable to shape the case body to have a substantially oval peripheral contour and thus a corresponding oval bottom, and arrange the pair of ribs to extend in a widthwise direction of the oval bottom in proximity to lengthwise end portions.

To improve mold release properties, it is preferable to make a core of a mold have an uneven or finely grained outer peripheral surface, which is for forming the inner periphery of the case body.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein:

FIG. 20 is a table showing results of experiments on properties of plastic cases with supporting ribs with respect to the thickness of upper ends of the supporting ribs;

DETAILED DESCRIPTION OF THE PREFERRED EMBODIMENT

Figure 1A:
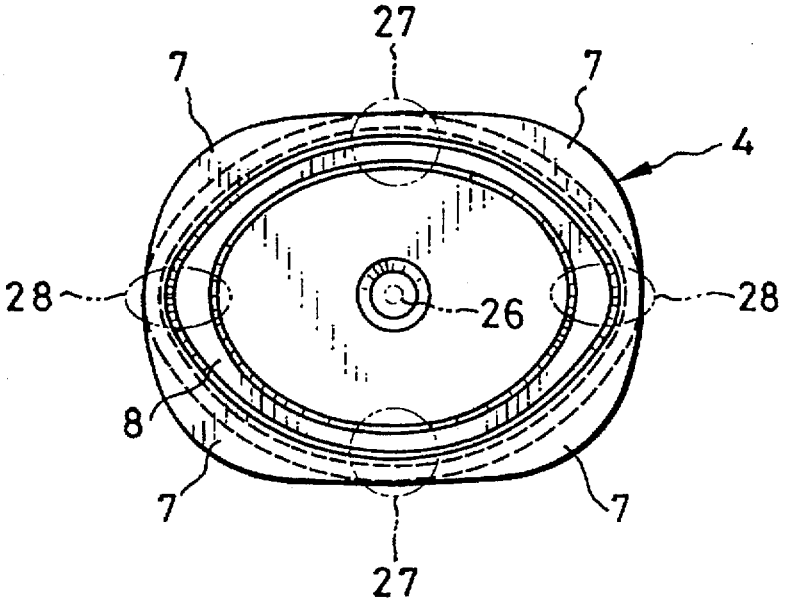
FIG. 1A is a top plan view of a plastic case for a photographic film cassette, according to a preferred embodiment of the invention.
Figure 1B:
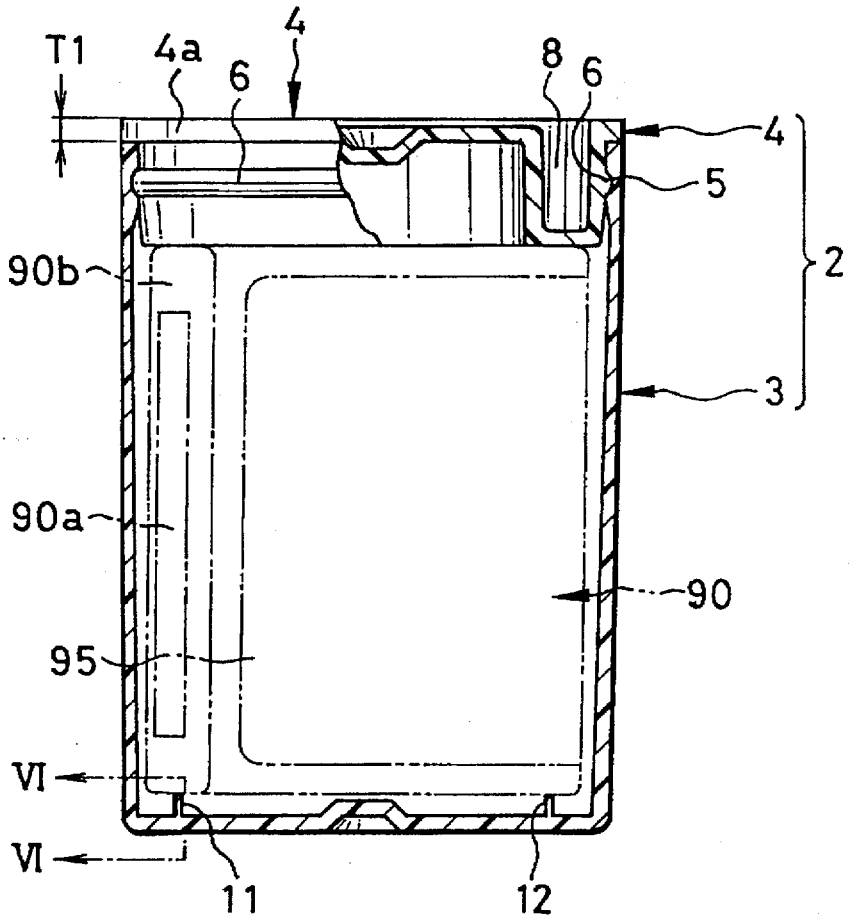
FIG. 1B is an elevational view, partly in section and partly broken away, of the plastic case of FIG. 1A.

As shown in FIGS. 1A and 1B, a plastic case 2 for a photographic film cassette 90 having a port portion **90*b* is constituted of a case body 3 and a lid 4. The case body 3 and the lid 4 are each formed from a synthetic resin material. The case body 3 is generally cylindrical and has a closed bottom and an open top for receiving the photographic film cassette 90 therein. The open top may be closed by the lid 4**.

Figure 3:
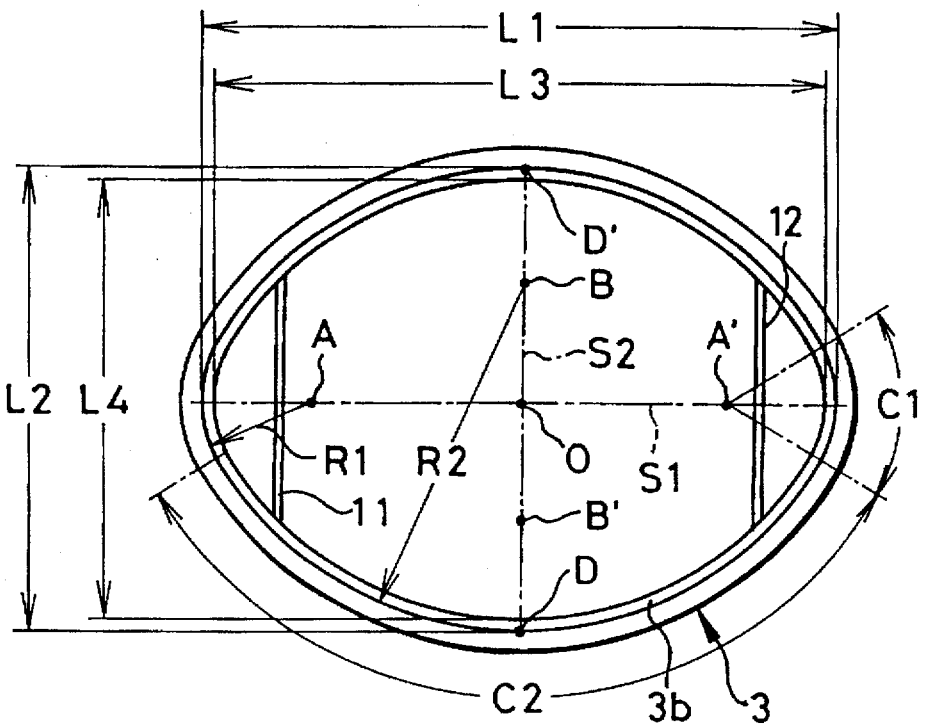
FIG. 3 is an explanatory top plan view of the case body illustrating a peripheral contour of the case body according to the embodiment shown in FIG. 2.
Figure 4:
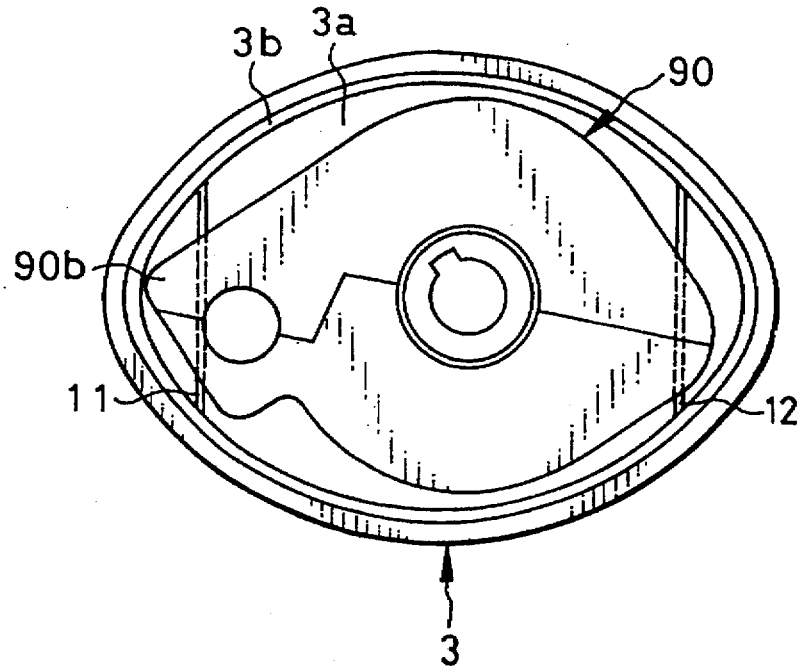
FIG. 4 is a top plan view of the case body, but holding a photographic film cassette therein.

FIG. 3 schematically shows the case body 3 viewed from the open top thereof. According to a preferred embodiment of the invention, the peripheral contour of the case body 3 is constituted of a pair of arcs C1 with a radius R1 (=5.5 mm) and another pair of arcs C2 with a larger radius R2 (=17.7 mm). The arcs C1 of one pair are continuous with the arcs C2 of the other pair to from an oval. The case body 3 has an internal diameter L1=32 mm in the lengthwise direction and an internal diameter L2=23 mm in the widthwise direction. The thickness of the side wall of the case body 3 is about 1 mm. FIG. 4 shows the photographic film cassette 90 received in the case body 3.

In order to hold the photographic film cassette 90 stably in the plastic case 2 while facilitating insertion of the cassette 90 into the case body 3, the case body 3 has decreasing diameters from the open top toward the bottom **3*b*. in this embodiment, the bottom 3*b* has a corresponding shape to the open top, and its lengthwise and widthwise diameters L3 and L4** are 31.5 mm and 22.5 mm, respectively.

If R1 and Rs represent a longer one and a shorter one of two different radii of two adjacent arcs in the irregular circle of the case body of the plastic case of the invention, it is preferable to determine the ratio R1/Rs to be 10 or less, more preferably 8 or less, and most preferably 5 or less. If the radius ratio R1/Rs is more than 10, the arc drawn with the longer radius would represent an approximately straight line. Since the tightness between the case body 3 and the lid 4 is diminished in such an almost straight portion, the moisture resistance of the plastic case 2 would be lowered at the ratio of R1/Rs>10. In the present embodiment, the radius ratio R1/Rs=R2/R1 (=17.7 mm/5.5 mm)=3.22.

The above described shape of the peripheral contour of the case body 3 may be obtained in the following manner:

First, draw a pair of semi-circles with the radius R1 (=5.5 mm) about two points A and A', respectively, which are disposed 10.5 mm apart from a center O on a lengthwise axis S1. Next, draw a widthwise axis S2 across the center O orthogonally to the lengthwise axis S1, and determine points D and D' on the widthwise axis S2 on opposite sides of the center O, 11.5 mm apart therefrom in correspondence with the widthwise diameter L2=23 mm. Then, draw a pair of semi-circles with the radius R2 (=17.7 mm) about two points B and B', respectively, which are disposed on the widthwise axis S2, 17.7 mm apart from the points D and D', respectively. Then, connect the four semi-circles to form a continuous curve.

Figure 5:
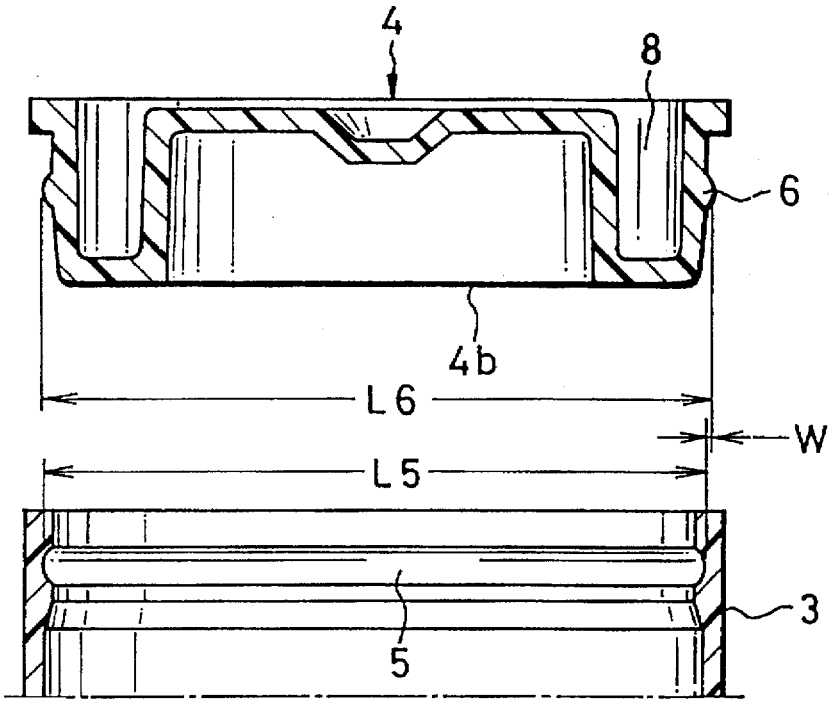
FIG. 5 is a vertical or axial sectional view illustrating essential parts for engagement between the case body and a lid of the plastic case according to the embodiment shown in FIG. 1B.

As shown in FIGS. 1B and 5, a groove 5 is formed around the annular inner periphery of the case body 3 near the open top thereof, whereas the lid 4 has a projection 6 annularly formed in correspondence with the groove 5. Since the projection 6 is engaged in the groove 5, the lid 4 is tightly fitted in the case body 3. The depth of the groove 5 is 0.3 mm. Therefore, the diameters of the oval formed by the bottom of the annular groove 5 are 32.6 mm and 23.6 mm in the lengthwise and widthwise directions, respectively.

The diameters of the oval formed by the top of the projection 6 are 33.2 mm and 24.2 mm in the lengthwise and widthwise directions of the lid 4, respectively, which are slightly larger than the lengthwise and widthwise diameters 32.6 mm and 23.6 mm of the groove 5. Accordingly, if L5 and L6 in FIG. 5 represent the maximum lengthwise diameters of the lid 4 at the top of the projection 6 and that of the case body 3 at the bottom of the groove 5, the projection 6 would protrude radially outward from the bottom of the groove 5 by an amount W (=0.3 mm). Therefore, the projection 6 of the lid 4 is force-fitted in the groove 5 of the case body 3, and the lid 4 is tightly engaged with the case body 3 due to the resiliency of the case body 3 and the lid 4.

The amount W may be any value, but should be larger than zero, preferably from 0.02 mm to 0.4 mm, more preferably from 0.05 mm to 0.3 mm. If the amount W is designed to be less than 0.02 mm, the actual amount W may be less than zero in some places due to variation of tolerance in molding. If the amount W is designed to be more than 0.4 mm, it would be difficult to reliably form the lid 4 because the lid 4 would require a great deal of force to be removed from the mold and the lid 4 might be broken. With that large amount W, the lid 4 would also be hard to remove from the case body 3.

As shown in FIG. 1A, the lid 4 has flanges 7 on an upper rim 4*a* thereof. The flanges 7 protrude about 0.5 mm to 3.5 mm radially outward from the outer periphery of the case body 3 when the lid 4 is fitted in the case body 3, so as to permit the fingers to catch the lid 4 so as to facilitate removal of the lid 4 from the case body 3. It may be possible to form such a flange around the circumference of the lid 4, but it is preferable to form the flanges 7 in the manner as shown in FIG. 1A. That is, crescent-shaped flanges 7 are formed between the top portions of the adjacent arcs C1 and C2. According to this construction, the external volume of the plastic case 2 can be small, so that the volume of a box for packaging the plastic case 2 can also be small.

It is to be noted that FIG. 5 shows an enlarged vertical section of the lid 4 and the case body 3 taken across portions having no flange 7, such as shown by 27 and 28 in FIG. 1A. As shown in FIG. 5, the lid 4 is formed with an annular recess 8. The recess 8 facilitates elastic bending of the lid 4 which is required when fitting and removing the lid 4 into and out of the case body 3. It is also preferable to provide knurls on the periphery of the flanges for facilitating removal of the lid.

As shown in FIG. 4, the port portion 90*b* of the photographic film cassette 90 protrudes radially from the periphery of the cassette 90. To improve space efficiency of the plastic case 2 for containing the photographic film cassette 90 having such a port portion 90*b*, the peripheral contour of the case body 3 is formed to be substantially oval. In view of the space efficiency, it is desirable to make a gap or play between the outer periphery of the cassette 90 and the inner periphery of the case body 3 as small as possible. However, if the play is too small, it would be difficult to insert the cassette 90 into the case body 3. If the play is too large, the photographic film cassette 90 would be so unstable in the plastic case 2 that the cassette 90 would knock the plastic case 2 and may scratch the inner wall of the case. In a worst case, the photographic film cassette 90 or the plastic case would be cracked. For this reason, the play between the plastic case 2 and the cassette 90 is set in a range from 0.5 to 2.0 mm.

Figure 2:
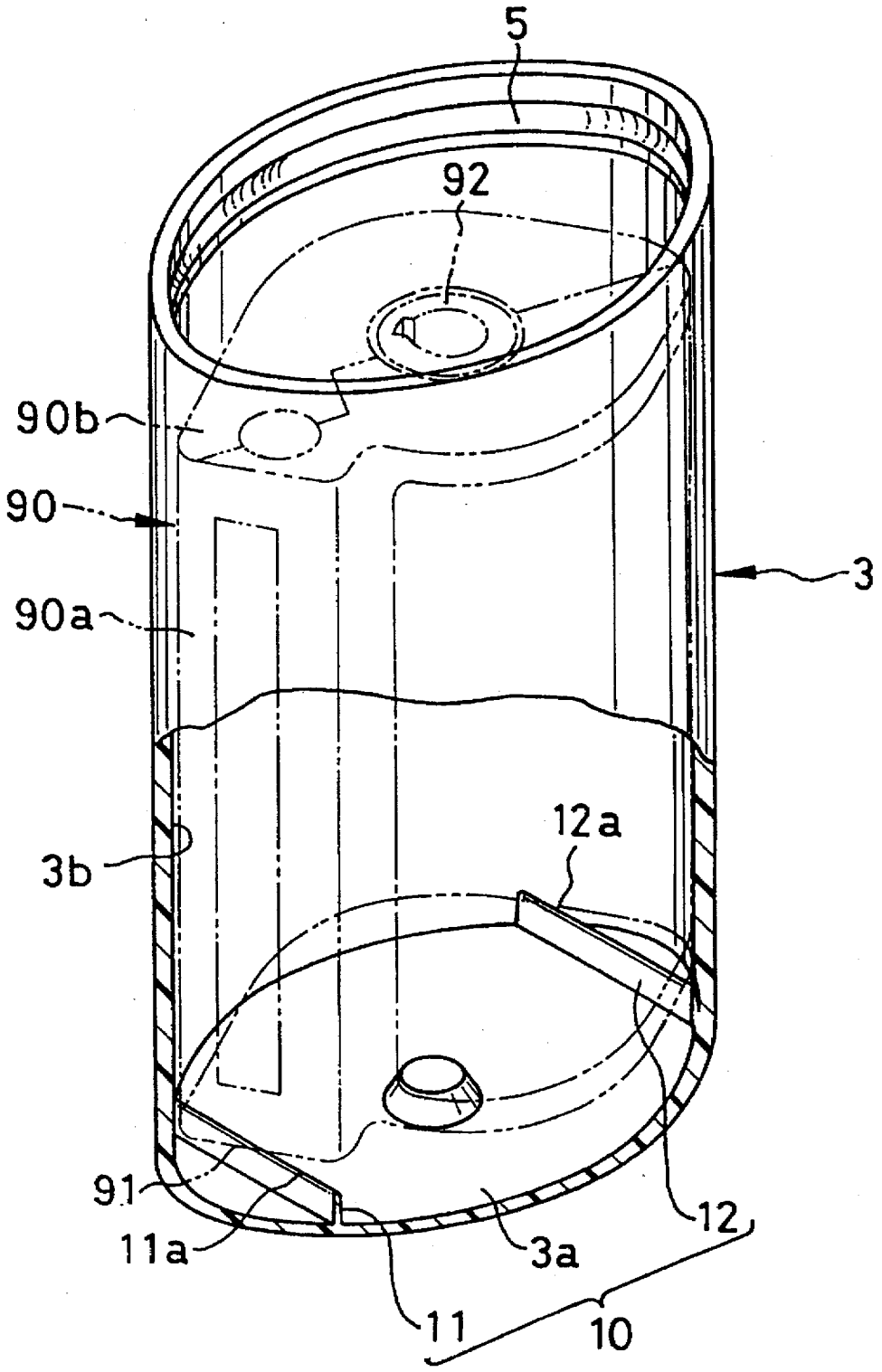
FIG. 2 is a perspective view of a case body of the plastic case shown in FIGS. 1A and 1B, having a pair of supporting ribs according to an embodiment of the invention.
Figure 6:
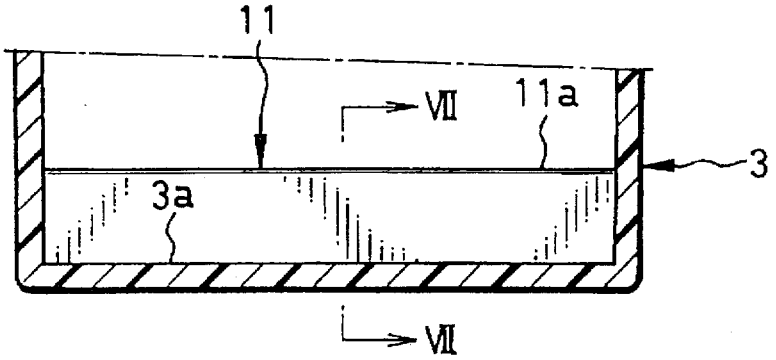
FIG. 6 is a fragmentary vertical sectional view taken along line VI—VI of FIG. 1B, illustrating one of the supporting ribs.

In order to hold the photographic film cassette 90 stably in the plastic case 2, a supporting device 10 is formed integrally on internal bottom surface 3*a* of the case body 3 so as to support a bottom or end face 91 of the cassette 90 thereon. According to the embodiment shown in FIG. 2, the supporting device 10 is constituted of a pair of supporting ribs 11 and 12 extending in the widthwise direction of the oval bottom 3*a* in proximity to lengthwise ends thereof. As shown in FIG. 6, an upper end 11*a*of the supporting rib 11 extends parallel to the internal bottom surface 3*a*, and an upper end 12*a* of the supporting rib 12 as well.

Figures 7A, 7B:
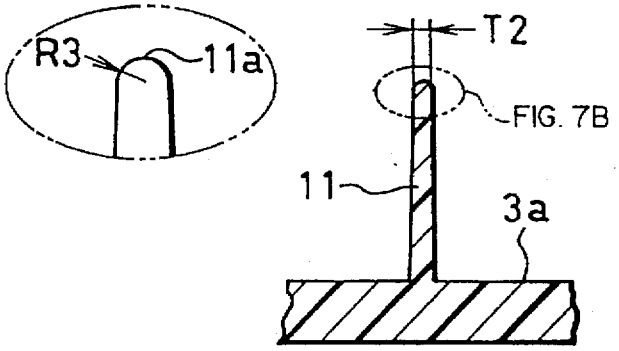
FIG. 7 is a vertical sectional view of the supporting rib taken along line VII—VII of FIG. 6.

As shown in FIG. 7, the upper end 11*a*has a thickness T2 of 0.2 mm, and the supporting rib 11 is tapered toward the upper end 11*a*. Also the upper end 11*a* is rounded at a radius R3 of curvature of 0.1 mm. The supporting rib 12 is formed equally. Moreover, the heights of the interior of the case body 3 and the supporting ribs 11 and 12 and that of the lid 4 are defined such that the photographic film cassette 90 supported on the supporting ribs 11 and 12 is slightly depressed by a bottom 4*b* of the lid 4 when the lid 4 is fitted to the case body 3, while deforming the upper ends 11*a* and 12*a* of the supporting ribs 11 and 12. Due to resiliency of the supporting ribs 11 and 12, the photographic film cassette 90 is held stably between the bottom 4*b* of the lid 4 and the supporting ribs 11 and 12.

Figure 8:
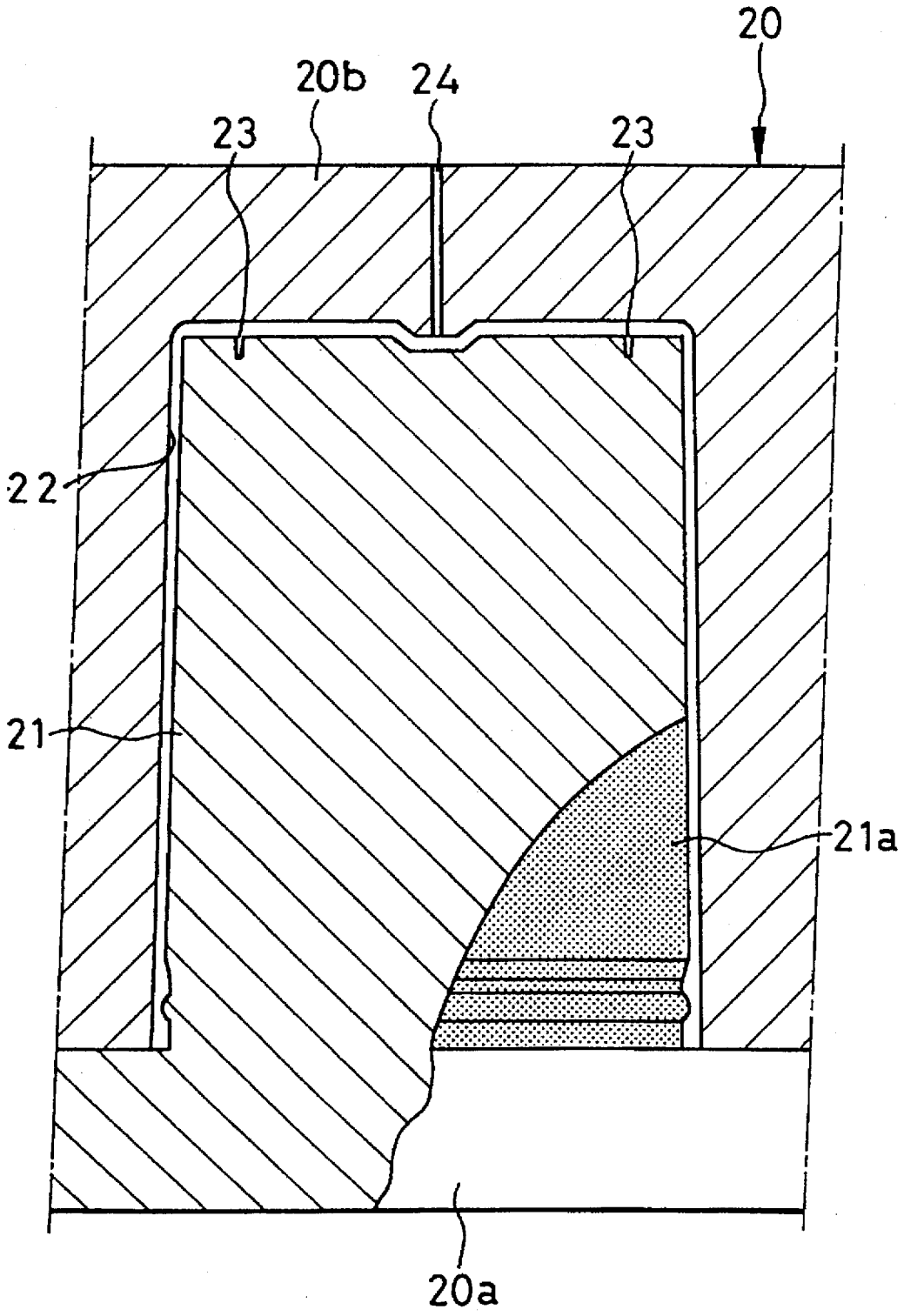
FIG. 8 is an explanatory view illustrating a molding process of the case body shown in FIG. 1B.

The case body 3 is formed by use of a mold 20 (see FIG. 8) which is constituted of a lower mold die 20*a* and an upper mold die 20*b*. The lower mold die 20*a* has a core 21 of a shape corresponding to the inner periphery of the case body 3. The upper mold die 20*b* has a cavity 22 of a shape corresponding to the outer periphery of the case body 3. With the bottom 3*a* closed, if the core 21 has an entirely flat surface, a vacuum would be made between the case body 3 and the core 21 while the case body 3 is being removed from the core 21 after the molding. Such a vacuum could plastically deform the bottom or peripheral wall of the case body 3. To prevent such a deformation, the core 21 of the mold 20 has a satin-finished, i.e. finely grained or granulated outer peripheral surface 21*a*. A pair of grooves 23 are formed in an upper end of the core 21, for forming the supporting ribs 11 and 12. The surfaces of the grooves 23 is also finely grained. A gate 24 is formed through the upper mold die 20*b*.

Any conventional method may be applicable to make the core surface 21*a* uneven or rough, but sandblasting is preferable because it is inexpensive and superior in workability.

Figure 9:
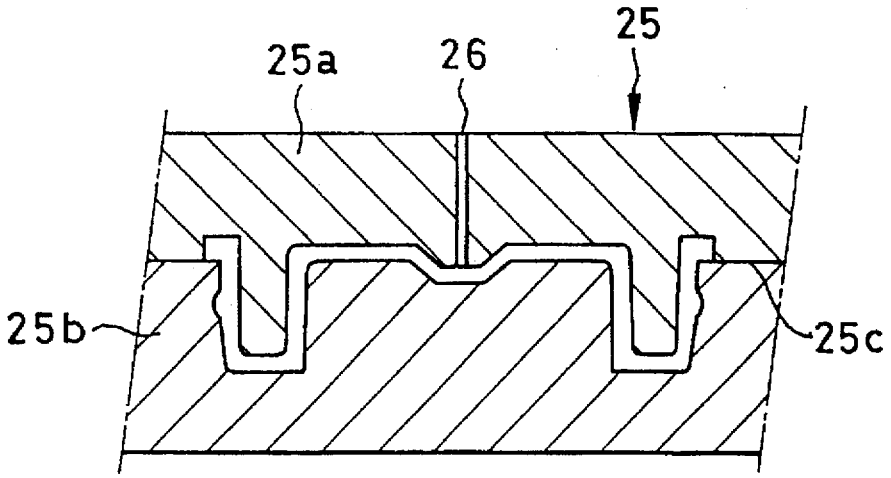
FIG. 9 is an explanatory view illustrating a molding process of the lid shown in FIG. 1A.

The lid 4 is formed from plastic resin by injection molding. As shown in FIG. 9, molds 25 for the lid 4 are constituted of upper and lower molds 25*a* and 25*b*. The resin is injected into the molds 25 through a gate 26 provided in a center of the molds 25, and spreads radially outward. At that time, because the length from the gate 26 to the rim 4*a* of the lid 4 varies according to the diameter, the resin reaches the ends 27 in the widthwise direction of the lid 4 faster than the ends 28 in the lengthwise direction, as shown by phantom lines in FIG. 1A. That is, the resin will flow from the widthwise ends 27 toward the lengthwise ends 28 along the rim 4*a* of the lid 4. Thereby, air in the molds 25 is pushed by the resin toward the lengthwise ends 28, and is discharged out of the molds 25 through small gaps provided along parting lines 25*c* between the upper and lower molds 25*a* and 25*b*.

If the thickness T1 of the rim 4*a* of the lid 4 is too large, the air gathered in the lengthwise ends 28 tends to stay in the upper portion of the lengthwise end 28. If the air remains in the molds 25, the portion of the resin that contacts the air would be undesirably colored due to heat energy radiated while the resin is being compressed. For this reason, it is preferable to design the thickness T of the rim 4*a* of the lid 4 to be not more than 2 mm, more preferably not more than 1.7 mm, and most preferably not more than 1.5 mm. However, with the thickness T of less than 0.5 mm, it becomes difficult for a person to reliably catch the flange 7 with their fingers so as to remove the lid 4. Accordingly, the thickness T1 should preferably be not less than 0.5 mm, and more preferably not less than 0.8 mm.

The engaging construction between the case body 3 and the lid 4 should not be limited to that shown in the drawings. For example, a lid may have a circumferential lip which is fitted on an outer periphery of a case body.

The resin for forming the plastic case 2 according to the present invention should be a thermoplastic resin including olefin polymer such as polystyrene, polyethylene, that is, high density polyethylene (HDPE), middle density polyethylene (MDPE), low density polyethylene (LDPE) or a mixture thereof, polypropylene (block copolymer, random copolymer, single polymer or a mixture thereof), and polyester resins such as polybutylene-terephthalate.

In order to prevent deformation due to external stress, it is preferable to use a material of high stiffness for forming the case body 3. For forming the lid 4, a material of lower stiffness is preferable for obtaining a high moisture resistance and facilitating opening and closing of the lid 4. The resin for forming the case body 3 preferably has a modulus in flexure of not less than 3000 kg/cm$^2$, more preferably not less than 6000 kg/cm$^2$, and most preferably not less than 8000 kg/cm$^2$. The resin for forming the lid 4 preferably has a modulus in flexure of not less than 800 kg/cm$^2$, more preferably not less than 1000 kg/cm$^2$, and most preferably not less than 1200 kg/cm$^2$. A preferable combination of the resin materials for the case body 3 and the lid 4 is polypropylene or high density polyethylene for the case body 3 and low density polyethylene for the lid 4.

The fluidity of the resin for the case body 3 should be not less than 7 in MI (melt index) or MFR (melt flow rate), preferably not less than 10, and more preferably not less than 15. The MI or MFR of the resin for the lid 4 should be not less than 5, preferably not less than 8, and more preferably not less than 12. The resin for the case body 3 should not be less than 7 in MI or MFR, and the resin for the lid 4 should not be less than 5 in MI or MFR. This is because the resin could not smoothly flow and hence short a shot may frequently occur during molding under those MI or MFR values.

It is preferable to add various admixtures to the resins for forming the case body 3 and the lid 4. That is, antioxidant is used for preventing oxidation of the resins that could be caused by a high temperature during the molding. Lubricants are used for improving the moldability and the smoothness for insertion of the photographic film cassette 90 into the plastic case 2 as well. Nucleating agent is used for promoting crystallization, shortening the molding cycle time, improving the stiffness or preventing deformation, and improving physical strength. Light screen agents or X-ray shielding materials are used for protecting the encased photographic film cassette 90 from ambient light or X-rays.

The antioxidant includes free radical chain terminators which react on and inactivate free radicals (mainly ROO—) that act as chain transfer agents in oxidation, and peroxide decomposers which decompose and stabilize hydroperoxide (ROOH) which is the main generator of the free radicals. The former includes phenolic antioxidant and aromatic amine antioxidant. The later includes sulfuric antioxidant and phosphoric antioxidant. For these reasons, it is preferable to use phenolic antioxidant and phosphoric antioxidant in combination in the present invention.

Because the antioxidant of various types are reducing agents which have adversely affect photographic materials, loading of the antioxidant is an important factor. The preferable loading of the mixture of phenolic and phosphoric antioxidant is from 0.001 to 2.0 wt % (weight percent), more preferably from 0.01 to 0.5 wt %, and most preferably from 0.03 to 0.3 wt %. A loading of less than 0.001 wt % has little anti-oxidizing effect, but merely increase the mixing and milling cost. A loading of more than 2.0 wt% of antioxidant would yield undesirable affects such as fogging or disordering of sensitivity on the photographic film, because the photographic film utilizes oxidizing and reducing effects for photographic recording.

As lubricants, which are loaded for improving the resin in moldability and increasing smoothness of the plastic case 2 on inserting the photographic film cassette 90, the following lubricants may be useful: saturated fatty acid amid lubricants such as behenic acid amid, stearic acid amid and palmitic acid amid; unsaturated fatty acid amid lubricants such as erucamide and oleamide; bis fatty acid amid lubricants such as methylene bisphenic amid, methylene bis-stearic acid amid, methylene bisoleic acid amid, ethylene bis-stearic acid amid, hexamethylene bis-stearic acid amid and hexamethylene bisoleic acid amid; silicone lubricant such as dimethyl polysiloxane and its modification; nonionic surface active agent lubricants; hydrocarbon lubricants such as liquid paraffin, natural paraffin, micro-wax, synthetic paraffin, polyethylene wax, polypropylene wax, chlorinated hydrocarbon and fluorocarbon; fatty acid lubricants such as high fatty acid (preferably C12 or more); ester lubricants such as lower alcohol ester of fatty acid and polyglycol ester of fatty acid; alcohol lubricants such as polyhydroxy alcohol, polyglycol and polyglycerol; and metallic soaps such as compounds of metal including Li, Mg, Ca, Sr, Ba, Zn, Cd, Al, Sn and pb with higher fatty acid including lauric acid, stearic acid, ricinoleic acid, naphthenic acid and oleic acid. It is possible to use a single one of these lubricants or a combination of more than one of these lubricants.

A preferable loading of the lubricants is from 0.01 to 5.0 wt %. A loading of less than 0.01 wt % has little lubricating effect, but merely increases the mixing and milling cost. A loading of more than 5.0 wt % may cause bleed-out or slipping of screws, increases in the frequency of molding errors and lower milling quality, because the resin emission amount would fluctuate with too much lubricants. In the case of fatty acid amid lubricants, which are inexpensive, they do not have adverse influences such as fogging and disordering of sensitivity on the photographic film, and are effective in increasing the smoothness and shortening the molding cycle time, the loading is preferably from 0.01 to 3.0 wt %, and most preferably from 0.02 to 1.0 wt %, in the interest of prevention of molding error and bleed-out and so forth. In the case of hydrocarbon lubricants or metallic soaps, which have less smoothing effects but contribute to improving upon dispersing quality of various admixtures and thus fluidity of the resin, it is possible to load them up to 20 wt % as long as no problem occurs.

Nucleating agents are added for speeding crystallizing and molding, improving stiffness, transparency, physical strength, and for preventing deformation. There are organic nucleating agents and inorganic nucleating agents. Representative examples of these nucleating agents are as follows:

Organic nucleating agents are carboxylic acid, dicarboxylic acid, salts and anhydride of these materials, salts and ester of aromatic sulfonic acid, aromatic phosphinic acid, aromatic phosphonic acid, aromatic carbonic acid and aluminum salts thereof, metallic salts of aromatic phosphoric acid, alkyl alcohol of C8 to C30, condensate of polyhydroxy alcohol and aldehyde, as well as alkyl amine, and include, for example, p-t-butyl-benzoic acid aluminum, 1,3.2,4-dibenzyliden sorbitol, di-substituted-dibenzyliden sorbitol compound, metallic salts such as calcium or magnesium salt of stearyl lactic acid, N- (2-hydroxyethyl) -stearyl amine, metallic salts such as lithium salt, sodium salt, potassium salt, calcium salt or magnesium salt of 1.2-hydroxy stearic acid, alkyl alcohol such as stearyl alcohol and lauric alcohol, benzoic soda, benzoic acid, and sebacic acid.

Inorganic nucleating agents are alkali metal hydroxide such as lithium hydroxide, sodium hydroxide and potassium hydroxide, alkali metal oxide such as sodium oxide, alkali metal carbonate such as lithium carbonate, sodium carbonate, potassium carbonate, sodium bicarbonate and potassium bicarbonate, alkali earth metal hydroxide such as calcium hydroxide, magnesium hydroxide and barium hydroxide, and alkali earth metal oxide such as calcium carbonate and calcium oxide.

Nucleating agents are not be limited to the above examples, but other known nucleating agents may be applicable. Of course, two or more nucleating agents may be added to the resin. A loading of the nucleating agent is from 0.01 to 2.0 wt %, preferably from 0.05 to 11.0 wt %. A loading of less than 0.01 wt % has little effect. On the other hand, the nucleating effect would not increase beyond the loading of 2.0 wt %, but the cost would increase.

As a light screen agent, which are used for protecting the photographic film cassette from ambient light, there are carbon black, graphite, aluminum powder, aluminum flakes, titanium oxide, calcium sulfate, barium sulfate, talc, clay, mica, stainless steal powder, starch, tin powder, pearlescent pigment, zinc oxide, potassium titanate, glass beads and so forth. These light screen agents may be used individually or in combination with each other, or in combination with dye. The above light screen agents may be subjected to some surface treatment. A preferable loading of the light screen is 0.01 to 30 wt %. A loading of less than 0.01 wt % would have almost no light shielding effect, but merely increase the milling cost.

In order to provide the plastic case 2 with an X-ray shielding property, at least one of barium compound, zinc or zinc compound, tin or tin compound, and lead or lead compound is loaded in the resin material at 10 to 50 wt %. However, appearance and drop impact strength are lowered by the loading of such a material unless the plastic case 2 has a sufficient thickness.

The above-described plastic case 2 for a photographic film cassette is required to have moisture resistance or moisture barrier characteristics of not more than 20 mg/24 hours, preferably not more than 15 mg/24 hours, more preferably not more than 10 mg/24 hours, and most preferably 5 mg/24 hours, although these values may be variable depending on the kind of the photographic film to be encased therein. In order to measure the moisture barrier characteristics, the weight of the plastic case 2 containing about 5 g of hygroscopic agent such as potassium chloride is measured before and after leaving the same for 24 hours under temperature of 40° C. and humidity of 90% RH.

To confirm the superior properties of the plastic case according to the present invention, ten pieces of plastic cases each having the same contour as above but the thickness T2 of the upper ends 11*a* and 12*a* of the supporting ribs 11 and 12 are varied from one another in a range from 0.07 to 0.04 mm. Concretely, three comparative examples having thicknesses T2 of 0.07 mm, 0.10 mm, and 0.40 mm, respectively, and six embodiments having thicknesses T2 of 0.12 mm, 0.14 mm, 0.20 mm, 0.25 mm, 0.30 mm, and 0.35 mm, respectively, were made for the experiment on moisture resistance, suitability for filling, and mold making facility. The overlapping amount in the engaging portion between the case body and the lid, that corresponds to the amount W in FIG. 5, was set at 0.3 mm. The upper ends 11*a*and 12*a*are semicircular in axial section.

The results are shown in Table of FIG. 20, wherein evaluation of each item is classified into four grades: very good (VG), good (G), usable in practice (O), and useless and necessary to improve (X).

In the comparative example 1 where the thickness T2 of the upper ends of the supporting ribs was 0.07 mm, deformation properties were very good, but suitability for filling were so bad that the supporting ribs could not be properly formed by molding, and some were torn off when removed from the mold. Moreover, the grooves of the mold core for molding the supporting ribs were difficult to form. As for the comparative example 2, suitability for filling were slightly better than example 1, but the grooves for molding the supporting ribs were difficult to form. On the other hand, the comparative example 3 as having a thickness T2 of 0.40 mm was improved in mold making facility and suitability for filling, so the supporting ribs were not torn off when removed from the mold. But the deformation properties of the supporting ribs were lowered so much that the lid was not tightly fitted into the case body with the photographic film cassette. As a result, barrier resistance was diminished. On the contrary, all of the embodiments 1 to 6 were usable in practice or better than usable. Accordingly, the thickness T2 is preferably from 0.12 mm to 0.35 mm, more preferably from 0.13 mm to 0.3 mm, and most preferably from 0.14 mm to 0.25 mm.

Figure 10:
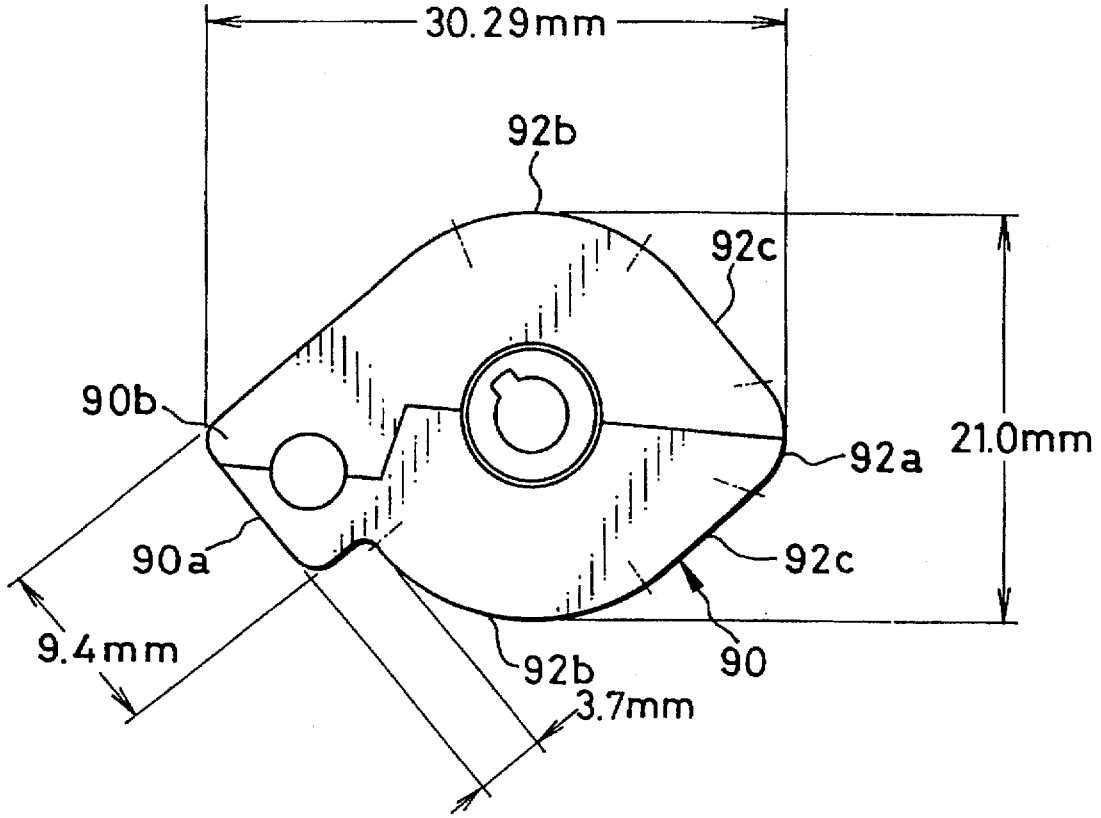
FIG. 10 is an explanatory view illustrating a peripheral contour of a photographic film cassette.

FIG. 10 shows the dimensions of the photographic film cassette 90 used in the above experiment. The photographic film cassette 90 has a peripheral contour which is mainly formed by an arc 92*a* of 4 mm radius, arcs 92*b* of 10.5 mm radius and straight portions 92*c* connecting these arcs to each other, and has a port portion 90*a* protruding 3.7 mm from the adjacent peripheral surface. In total, the irregular shape is 30.29 mm by 21 mm in diameter. It is preferable to determine the radii of the two kinds of arcs 92*a* and 92*b*, which substantially determine the lengthwise and widthwise diameters of the photographic film cassette 90 within a range of ±20% around the above-mentioned values, respectively. It is more preferable to determine the radii within a range of ±10%, and most preferably within a range of ±5% around the above-mentioned values, respectively. If the radii of the arcs 92*a* and 92*b* differ more than 20% from the above-mentioned values, it will be difficult to make the photographic film cassette have a streamlined contour.

It is to be noted that the upper ends of the supporting ribs 11 and 12 are not necessarily rounded, but may be flat, triangular, or trapezoid, etc. In a case of a supporting rib with a flat top surface, the thickness of the flat top surface may be regarded as the thickness T2. In a case of supporting rib with a triangular upper end, the thickness T2 is measured at 0.2 mm down from the peak.

Figure 11:
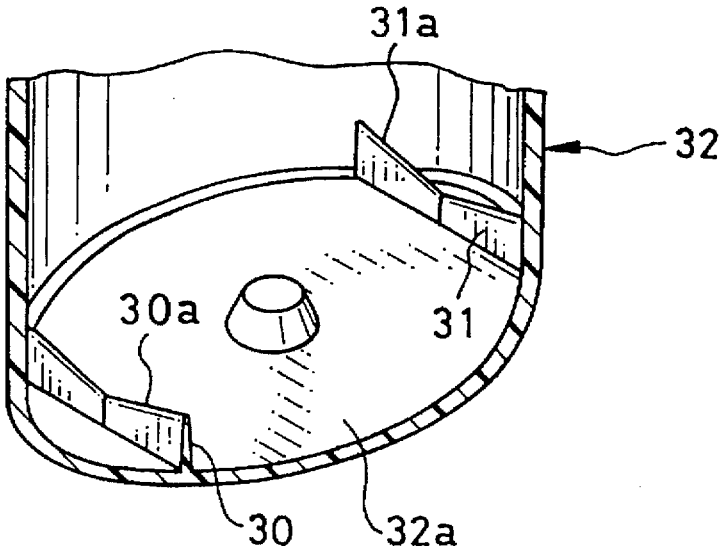
FIG. 11 is a fragmentary perspective view of supporting ribs according to another embodiment of the invention.

Also, the supporting device 10 may be configured otherwise. FIG. 11 shows another embodiment of the supporting device, wherein a pair of supporting ribs 30 and 31 are arranged in parallel to each other on opposite end portions of an internal bottom surface 32*a* of a case body 32, and upper ends 30*a* and 31*a* of the ribs 30 and 31 are gently inclined toward a middle portion of each rib to form a V-shaped crest line. This configuration is useful for centering a photographic film cassette in the case body 32. The inclination of the upper ends 30*a* and 31*a* relative to the internal bottom surface 32*a* is preferably 6–20 degrees, more preferably 8–18 degrees, and most preferably 9–16 degrees.

Figure 12:
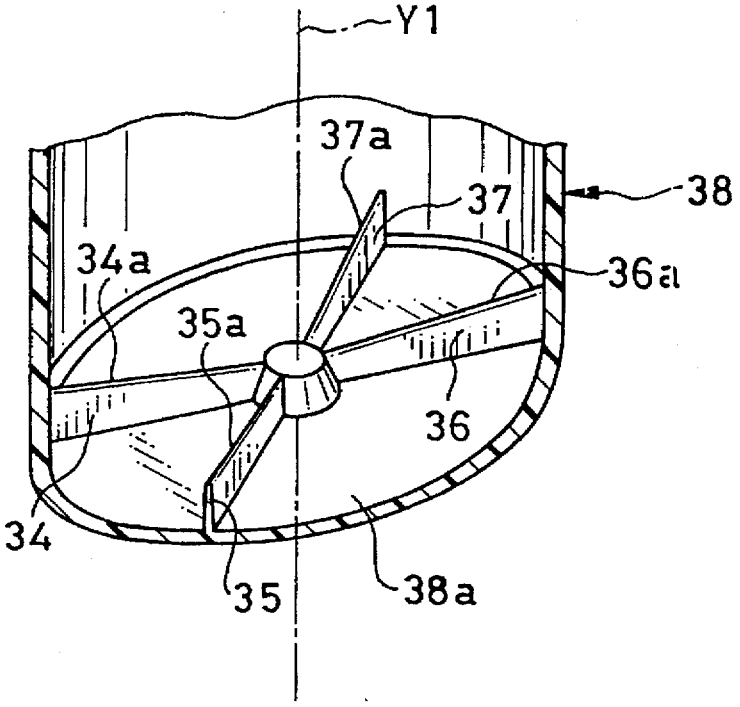
FIG. 12 is a view similar to FIG. 11, but illustrating supporting ribs according to still another embodiment of the invention.

FIG. 12 shows another embodiment of the supporting device, wherein four supporting ribs 34, 35, 36 and 37 are arranged radially to a vertical center axis Y1 of a case body 38. The ribs 34 to 37 are formed integrally on an internal bottom surface 38*a* of the case body 38, and upper ends 34*a*, 35*a*, 36*a* and 37*a* are inclined downward to the vertical center axis Y1. Also this configuration is useful for centering a photographic film cassette in the case body 38. If the internal bottom surface 38*a* is substantially oval, as shown in FIG. 12, the supporting ribs 34 to 37 may be arranged along lengthwise and widthwise center axes of the oval internal bottom surface 38*a*, through they are arranged diagonally in FIG. 12. It is possible to provide more than four radial supporting ribs.

Figure 13:
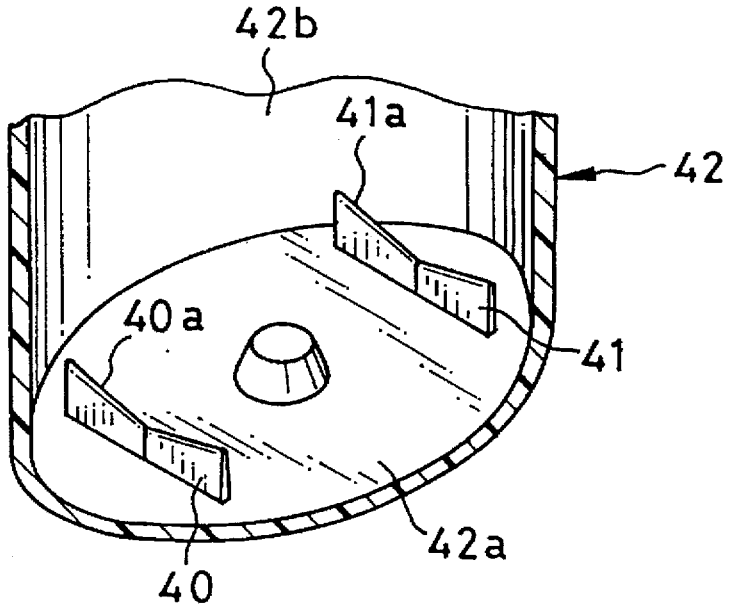
FIG. 13 is a view similar to FIG. 11, but illustrating supporting ribs according to a further embodiment of the invention.

FIG. 13 shows a modification of the embodiment of FIG. 11, wherein a pair of supporting ribs 40 and 41, whose upper ends 40*a*and 41*a* are inclined downward to a middle point thereof, are formed on an internal bottom surface 42*a* of a case body 42 separately from a internal periphery 42*b* thereof. Separation from the internal periphery makes the supporting ribs 40 and 41 easier to deform, so that the upper ends 40*a* and 41*a* may be relatively thick. Therefore, this embodiment is improved in moldability and mold making properties. It is possible to separate the supporting ribs 11 and 12, or 34 to 37 from the internal periphery of the case body.

Figure 14:
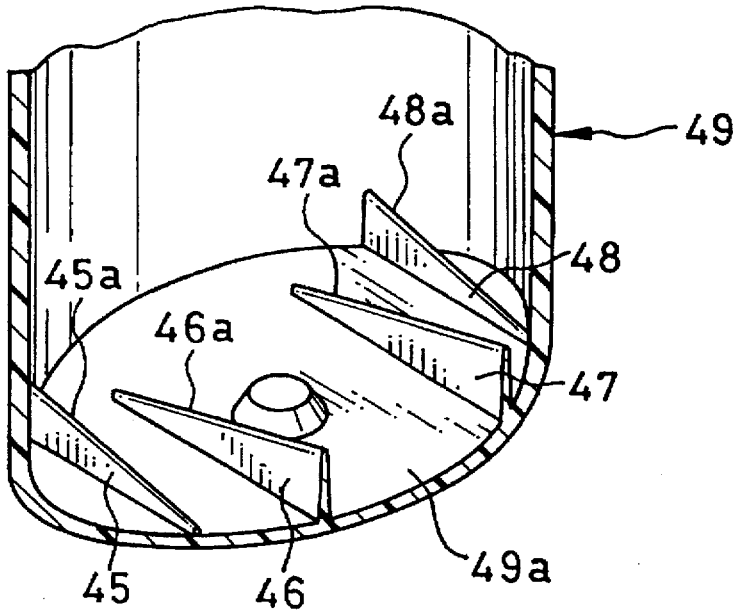
FIG. 14 is a view similar to FIG. 11, but illustrating supporting ribs according to another embodiment of the invention.

According to an embodiment shown in FIG. 14, four supporting ribs 45, 46, 47 and 48 are arranged in parallel to one another on an internal bottom surface 49*a* of a case body 49, and upper ends 45*a* and 46*a*; 47*a* and 48*a* of adjacent two of the four supporting ribs 45 to 48 are inclined relative to the internal bottom surface 49*a* in opposite directions from each other. This configuration is more effective to restrain fluctuation of a photographic film cassette. The same effect may be achieved by providing three or more supporting ribs having alternately oppositely inclined upper ends.

Figure 15:
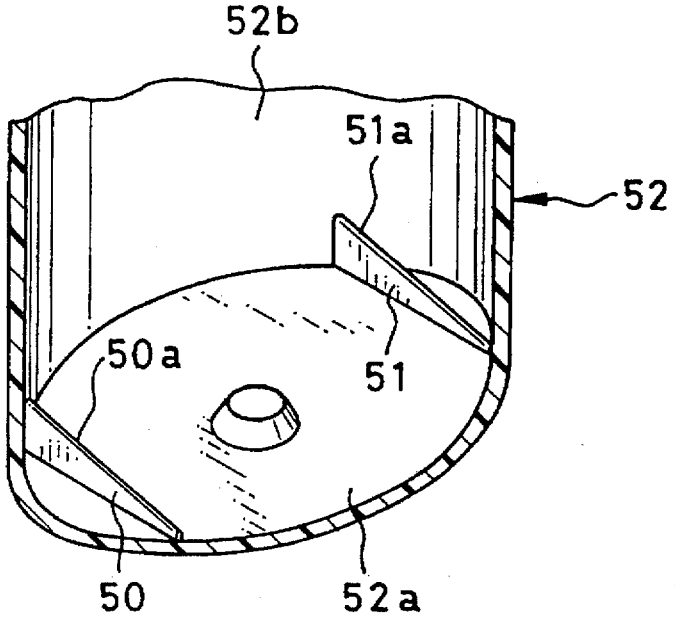
FIG. 15 is a view similar to FIG. 11, but illustrating supporting ribs according to another embodiment of the invention.

It is also possible to provide supporting ribs 50 and 51 with upper ends 50*a* and 51*a* inclined in the same direction relative to an internal bottom surface 52*a* of a case body 52, as is shown in FIG. 15. According to this embodiment, a photographic film cassette would move downward to bring its peripheral surface into contact with an internal peripheral surface 52*b* of the case body 52. Because being thus supported at an increased number of points by the case body 52, the cassette is held more stable in the case body 52. It is desirable to design the shape and inclination angle of each of the supporting ribs 45 to 48, 50 and 51 such that the photographic film cassette 90 is supported with its bottom, i.e. an end face 91 of the cassette 90, horizontal or parallel to the internal bottom surface of the case body.

Figure 16:
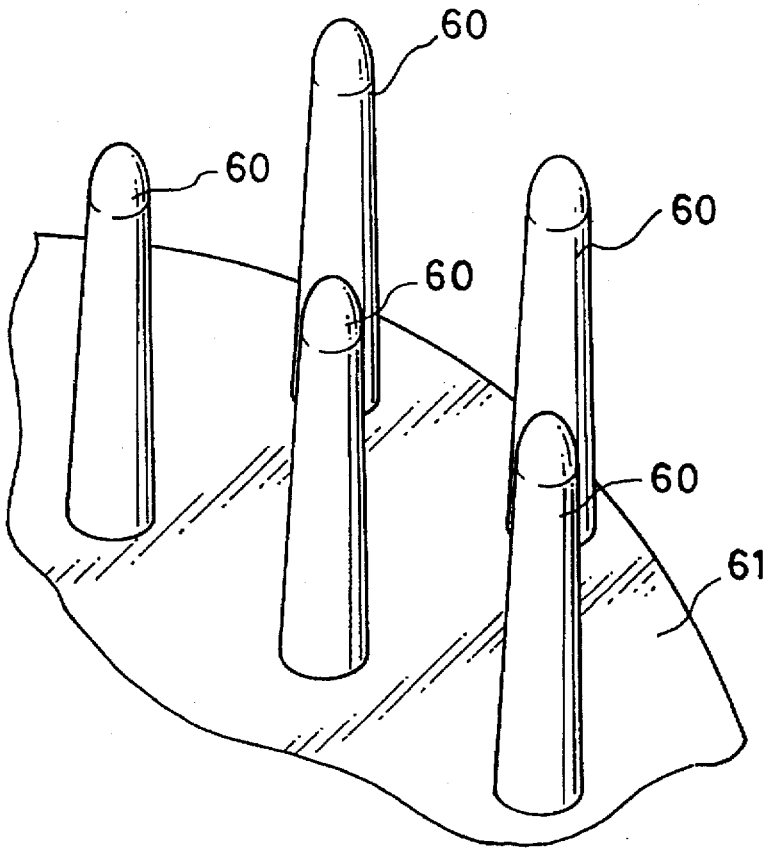
FIG. 16 is an explanatory enlarged view illustrating a further embodiment of supporting device consisting of a plurality of fine projections.

As the supporting device, it is possible to construct a supporting device by a great number of fine projections 60 integrally formed on an internal bottom surface 61 of a case body, instead of the supporting ribs as above. The shape of the projection 60 may be circular conic, as shown in FIG. 16, or may be pyramidal, cylindrical, or prismatic. The projections 60 may be disposed in the whole area of the internal bottom surface 61, or in correspondence with the supporting ribs of any one of the above embodiments, or in other portions of the internal bottom surface 61. The height of the projections 60 may be changed such that tips of the projections 60 form the same inclination as the supporting ribs shown in FIGS. 11, 12, 13, 14 or 15. It is also possible to form a molding gate as the supporting device by protruding the gate inwardly from the bottom of a case body, though this embodiment is not shown in the drawings.

Figure 17:
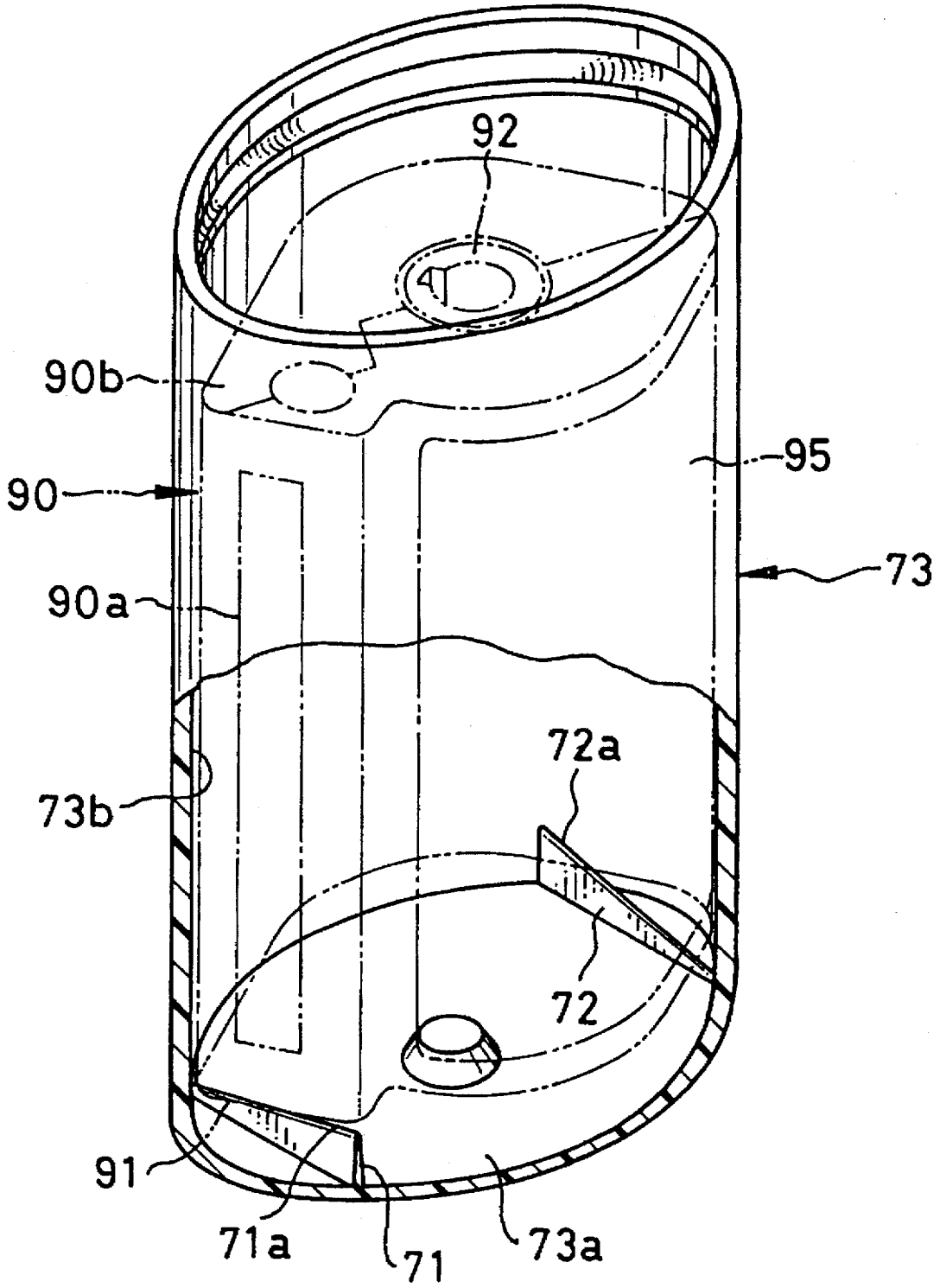
FIG. 17 is a perspective view of supporting ribs according to another preferred embodiment of the invention.

FIG. 17 shows another preferred embodiment of the invention, wherein a pair of supporting ribs 71 and 72, which are formed integrally on an internal bottom surface 73*a* of a case body 73, have upper ends 71*a* and 72*a* inclined oppositely relative to the internal bottom surface 73*a*. The case body 73 has a substantially oval peripheral contour like the case body 3, and thus the internal bottom surface 73*a* is substantially oval. Like the embodiment shown in FIGS. 2 and 15, the supporting ribs 71 and 72 extend in the widthwise direction of the internal bottom surface 73*a* on opposite lengthwise ends.

Figure 18A:
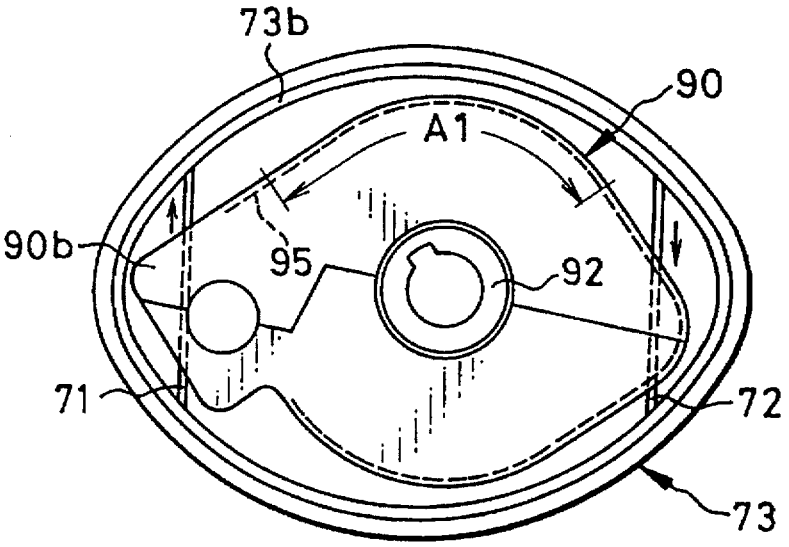
FIGS. 18A and 18B are explanatory views illustrating the operation of the supporting ribs according to the embodiment of FIG. 17.
Figure 18B:
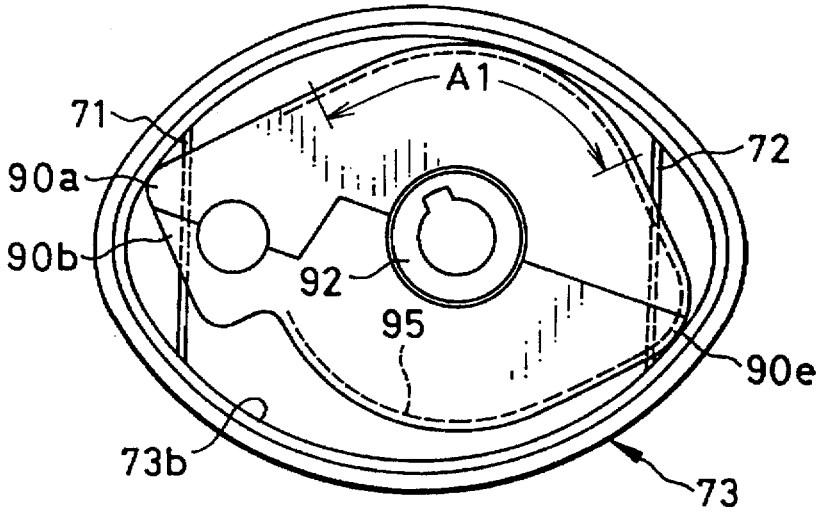

Because of the opposite inclinations of the upper ends 71*a* and 72*a*, a photographic film cassette 90 inserted in the case body 73 slides on the supporting ribs 71 and 72 to rotate about its axis slightly in a clockwise direction in FIG. 17, as is indicated by arrows in FIG. 18A. As a result, a corner 90*d* of a port portion 90*b* of the photographic film cassette 90, which is the farthest from a spool 92 of the cassette 90, and an opposite corner 90*e* both get into contact with an internal periphery 73*a* of the case body 73, as is shown in FIG. 18B. Thus, the photographic film cassette 90 is supported by the internal periphery 73*b* as well as by the supporting ribs 71 and 72, so that the photographic film cassette 90 is held still more stable in the case body 73.

It is possible to design the case body 73 and the supporting ribs 71 and 72 such that, in addition to the corners 90*d* and 90*e*, also a peripheral portion of the photographic film cassette 90 is brought into contact with the internal periphery 73*b* of the case body 73.

Figure 19:
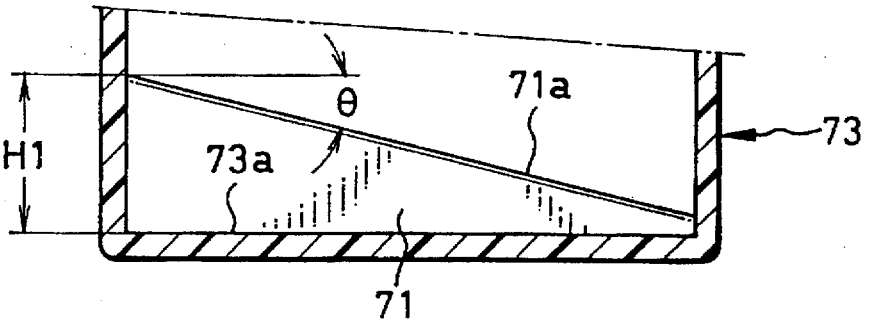
FIG. 19 is a fragmentary vertical sectional view illustrating one of the supporting ribs of FIG. 17.
Figure 21:
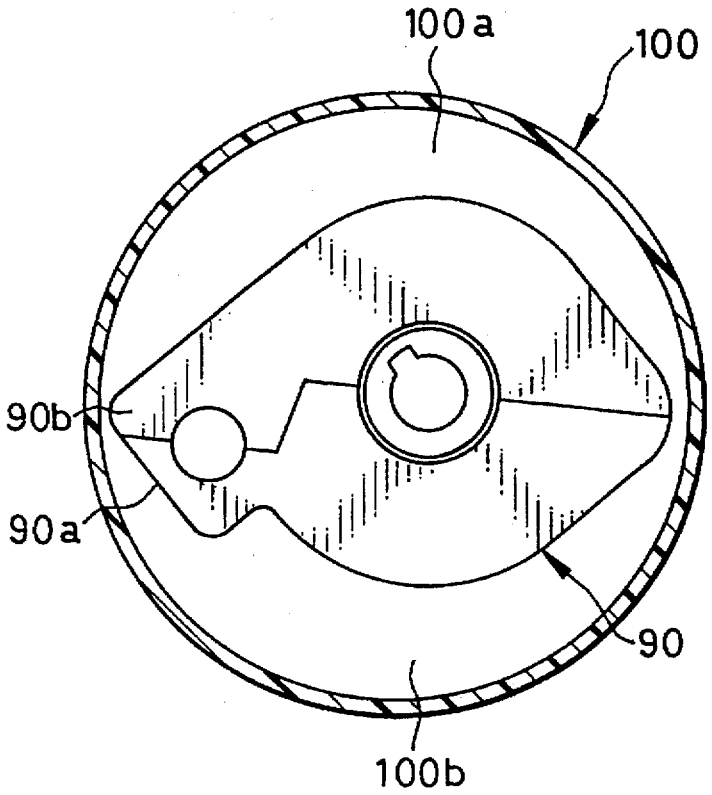
FIG. 21 (PRIOR ART)
FIG. 21 is an explanatory view of a case body of a conventional plastic case, containing a photographic film cassette having a peripheral contour similar to that shown in FIG. 10.
Figure 22:
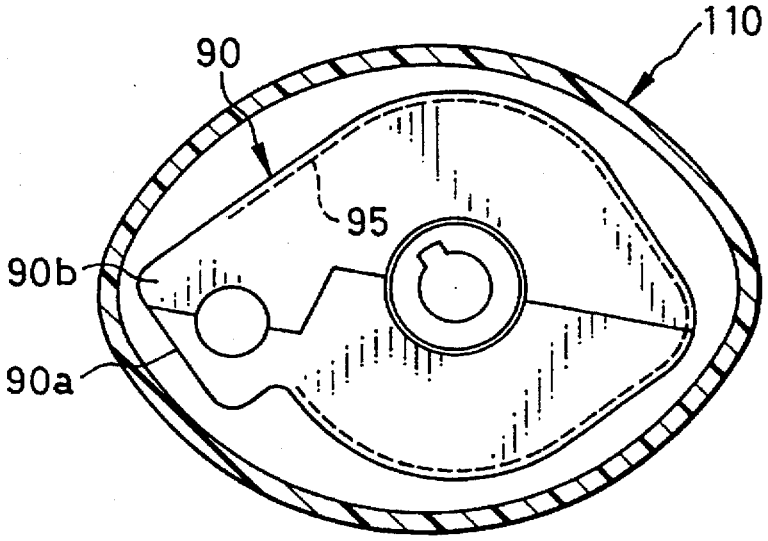
FIG. 22 (PRIOR ART)
FIG. 22 is an explanatory view of a case body having an oval or oblong peripheral contour, containing the same photographic film cassette as shown in FIG. 21.

According to the present embodiment, the inclination angle θ of the upper end 71*a* of the supporting rib 71 relative to the internal bottom surface 73*a*, see FIG. 19, is 14 degrees. The supporting rib 72 has the same configuration as the supporting rib 71. It was proved that the inclination angle θ should not be less than 6 degrees to ensure the photographic film cassette 90 to slide on the supporting ribs 71 and 72 to rotate into contact with the internal periphery 73*b* of the case body 73. A maximum height H1 of the rib 71 is determined with respect to the inclination angle θ , the height of the case body 73 from the internal bottom surface 73*a* to a bottom surface of an associated lid, and the axial length of the photographic film cassette 90. The lid associated to the case body 73 may have the same configuration as the lid 4 shown in FIGS. 1A and 1B, or may have another configuration.

The thickness of the supporting ribs 71 and 72 may be defined in the same way as described with respect to the supporting ribs 11 and 12 of the first embodiment. It was found that the thickness of the upper ends 71*a* and 72*a* of the supporting ribs 71 and 72 is preferably from 0.12 to 0.35 mm, more preferably 0.13 to 0.3 mm, and most preferably from 0.14 to 0.25 mm. Similarly to the first embodiment, defining the thickness of the upper ends 71*a* and 72*a* of the supporting ribs 71 and 72 in this range results in appropriate deformation properties of the ribs 71 and 72, in view of moisture resistance in a condition closed with the associated lid and stability of the contained cassette 90 as well, while keeping sufficient suitability for filling and mold making facility.

Since a peripheral area A1 between the corners 90*d* and 90*e* is placed closer to the internal periphery 73*b* of the case body 73 after the photographic film cassette 90 is inserted in the case body 73, as is shown in FIG. 18B, a label 95 on the periphery of the cassette 90 can be easy to read through the peripheral portion of the case body 73 where the peripheral area A1 is positioned behind, even if the case body 73 is formed from a semi-transparent synthetic resin material. Accordingly, it is desirable to print important information in the area A1 on the label 95.

As described so far, according to the present invention, because a resiliently deformable supporting device is formed integrally on an internal bottom surface of a case body of a plastic case, a photographic film cassette is held stable in the plastic case even if the cassette has a radially protruding port portion, or even while the plastic case is being transported. In addition, according to the embodiment shown in FIG. 17, the label on the photographic film cassette contained in the plastic case is visible through the peripheral wall of the case even when the plastic case is formed from semitransparent synthetic resin material.

Although the case bodies shown in the drawings have basically oval peripheral contours, the supporting device of the invention is applicable to a conventional cylindrical plastic case for a photographic film cassette, and other plastic cases having various peripheral contours such as triangular, rectangular, polygonal, and composite forms thereof.

Thus, the present invention should not be considered to be limited to the above described embodiments but, on the contrary, various modifications are possible to those skilled in the art without departing from the scope of the appended claims.

What is claimed is:

1. A plastic case for a photographic film cassette, comprising:

a case body having a closed bottom and an open top;

a lid to be fitted to said open top of said case body; and a supporting device having an upper surface and a plurality of planar side surfaces, formed unitarily with said case body and upwardly projecting from an internal bottom surface of said case body, said planar side surfaces of said supporting device being upwardly tapered and said upper surface which is deformable downwardly by said photographic film cassette when said lid is fitted to said case body and depresses said photographic film cassette into said case body.

2. A plastic case as claimed in claim 1, wherein said supporting device is constituted of a plurality of ribs whose upper ends have a 0.12 to 0.35 min.

3. A plastic case as claimed in claim 2, wherein said plurality of ribs are a pair of ribs extending in parallel to each other.

4. A plastic case as claimed in claim 3, wherein said case body has a substantially oval peripheral contour, and said pair of ribs extend in a widthwise direction of said internal bottom surface having a corresponding oval shape in proximity to lengthwise ends of said internal bottom surface.

5. A plastic case as claimed in claim 2, wherein said upper ends of said plurality of ribs are inclined relative to said internal bottom surface of said case body.

6. A plastic case as claimed in claim 5, wherein said upper ends are inclined at an inclination angle of not less than 6 degrees.

7. A plastic case as claimed in claim 5, wherein, said upper ends of adjacent two of said plurality of ribs are inclined in opposite directions to each other.

8. A plastic case ae as claimed in claim 1, wherein a plurality of ribs are arranged radially to a vertical center axis of said case body, and upper ends of said ribs are inclined downwardly toward said vertical center axis of said case body.

9. A plastic case as claimed in claim 2, wherein said plurality of ribs are separated from an inner periphery of said case body.

10. A plastic case as claimed in claim 1, wherein said plastic case is formed from a transparent or semi-transparent synthetic resin material.

11. A plastic case for a photographic film cassette, comprising:

a case body having a closed bottom and an open top;

a lid to be fitted to said open top of said case body; and a supporting device having an upper surface and a plurality of planar side surfaces, formed unitarily with said case body and upwardly projecting from an internal bottom surface of said case body, said supporting device being inclined such that said photographic film cassette may slide on said supporting device to rotate about an axis of said photographic film cassette and stop in a position where an outer peripheral area of said photographic film cassette is set closer to an inner periphery of said case body.

12. A plastic case as claimed in claim 11, wherein said supporting device is constituted of a pair of ribs disposed apart from each other, each of said ribs being tapered toward an upper end thereof, said upper ends being inclined in opposite directions to each other relative to said internal bottom surface of said case body.

13. A plastic case as claimed in claim 12, wherein said upper ends have a thickness of 0.12 to 0.35 mm, and are inclined at an inclination angle of not less than 6 degrees.

14. A plastic case as claimed in claim 13, wherein said photographic film cassette has a generally cylindrical outer periphery and a port portion radially protruding from said outer periphery, and a label having information about said photographic film cassette is put on said outer periphery.

15. A plastic case as claimed in claim 14, wherein said photographic film cassette is in contact with said inner periphery of said case body at least at said port portion when stopped after sliding on said ribs.

16. A plastic case as claimed in claim 14, wherein said plastic case is formed from a transparent or semi-transparent synthetic resin material.

17. A plastic case as claimed in claim 16, wherein said case body has a substantially oval peripheral contour, and said pair of ribs extend in a widthwise direction of said internal bottom surface having a corresponding oval shape in proximity to lengthwise ends of said internal bottom surface.

* * * * *